United States Patent [19]

Harlan et al.

[11] 4,019,572

[45] Apr. 26, 1977

[54] RADIATOR ASSEMBLY FOR FLUID FILLED ELECTRICAL APPARATUS

[75] Inventors: Larry R. Harlan, Muncie; Patrick L. Thiel, Springport, both of Ind.

[73] Assignee: Westinghouse Electric Corporation, Pittsburgh, Pa.

[22] Filed: June 23, 1975

[21] Appl. No.: 589,098

[52] U.S. Cl. ..... 165/106; 165/130; 165/175; 336/58; 29/157.3 R

[51] Int. Cl.[2] ..... F28D 15/00

[58] Field of Search ..... 165/106, 47 T, 130, 165/175, 166, 167; 336/58, 57, 55; 29/157.3 R

[56] References Cited

UNITED STATES PATENTS

| | | | |
|---|---|---|---|
| 1,735,289 | 11/1929 | McClintock | 165/106 |
| 1,897,113 | 2/1933 | Doucet | 165/130 |
| 3,153,447 | 10/1964 | Yoder et al. | 165/175 X |
| 3,650,321 | 3/1972 | Kaltz | 165/175 X |

*Primary Examiner*—Albert W. Davis, Jr.
*Attorney, Agent, or Firm*—C. L. McHale; D. R. Lackey

[57] ABSTRACT

A radiator assembly having several radiator sections connected together by integral flanges which are telescoped together. Each radiator section is constructed of two metal panels which are identical and which are mated together and welded. Corrugated surfaces on each panel define ducts through which the fluid flows. The corrugation ridges on one panel are aligned with the corrugation furrows on its mating panel. The ridges on the panels are also aligned with the furrows on the facing panels of the adjacent radiator sections.

5 Claims, 6 Drawing Figures

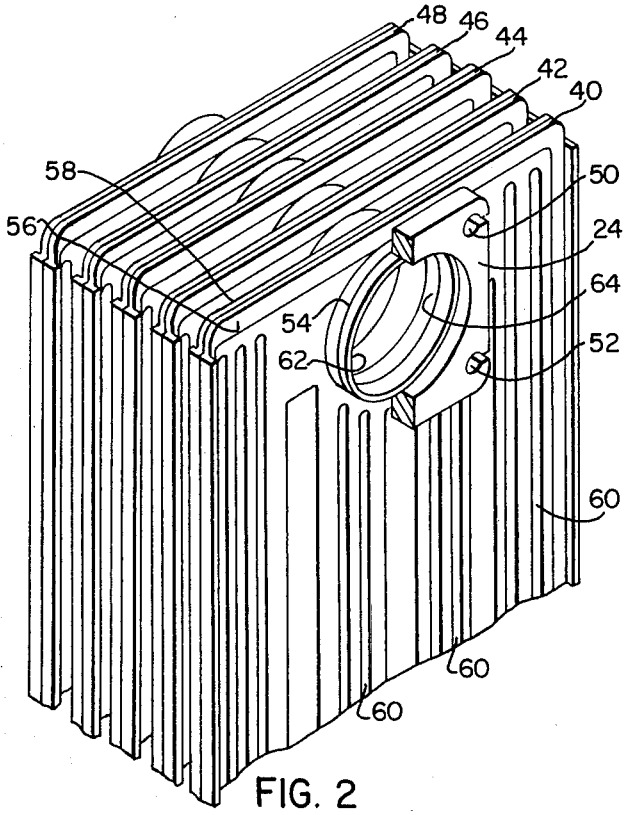
FIG. 2
FIG. 6
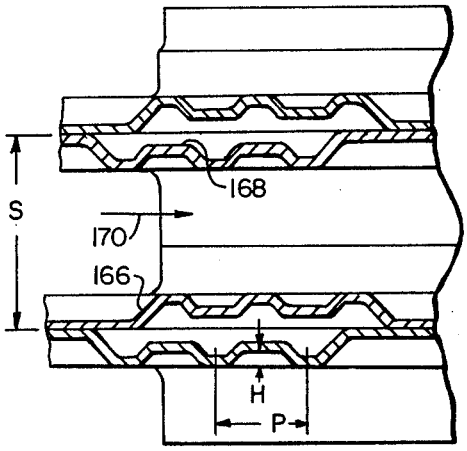
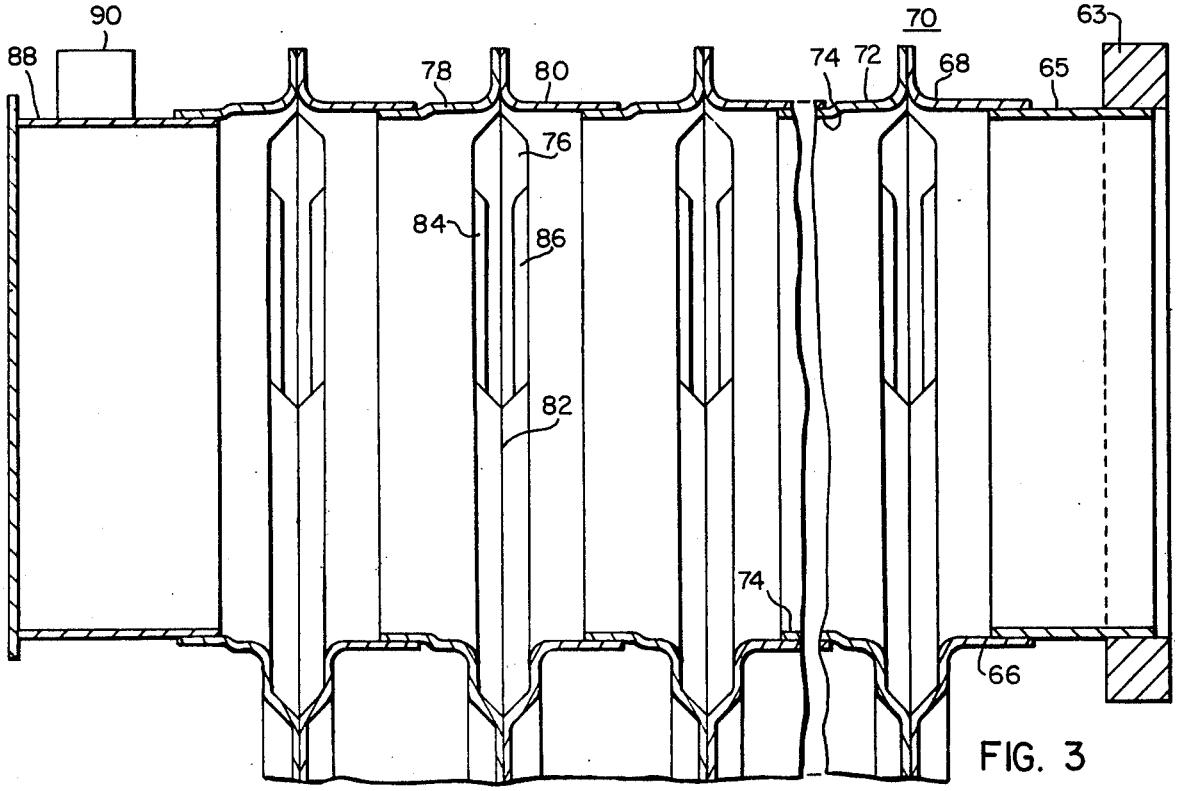
FIG. 3

RADIATOR ASSEMBLY FOR FLUID FILLED ELECTRICAL APPARATUS

BACKGROUND OF THE INVENTION

1. Field of the Invention:

This invention relates, in general, to heat exchangers and, more specifically, to radiator assemblies for fluid filled electrical apparatus.

2. Description of the Prior Art:

Radiator assemblies for fluid filled electrical apparatus have been constructed in many different shapes and arrangements. Some of the most efficient arrangements use sheet metal panels which are formed and welded together to provide ducts through which the liquid coolant flows. Several of these two-panel combinations, or radiator sections, are connected together in flow communication relationship by a header assembly which is connected to the electrical apparatus enclosure.

One widely used prior art radiator arrangement uses a plurality of radiator sections which have openings at their top and bottom ends which, when connected to a simple header assembly, permit the flow of coolant through the ducts of the radiator sections. A considerable number of welded or brazed joints are created on each section to form a liquid tight seal with the header assembly. These joints require a considerable amount of labor expense and are regarded as possible locations of failure and fluid leakage.

The thermal efficiency of a radiator assembly is dependent upon many factors, including the shape and dimensions of the radiating panels and the space between the panels. Generally, the more surface area across which the coolant flows, the more efficient the radiator system. Other factors, such as the amount of air flow between the radiator sections, also affect the thermal efficiency.

It has also been desired to construct the most efficient radiator assembly commensurate with manufacturing costs and reliability. Therefore, it is desirable, and it is an object of this invention, to provide an easily constructed radiator assembly which is more reliable and more efficient than prior art radiator assemblies.

SUMMARY OF THE INVENTION

There is disclosed herein a new and useful radiator assembly which provides better efficiency than radiator assemblies constructed according to the prior art. The disclosed radiator assembly includes a plurality of radiator sections which are connected together by flanges which extend from the metal panels which form the radiator sections. Each radiator section contains a plurality of vertically extending ducts through which the fluid coolant flows. These ducts are defined by corrugated surfaces on the panels which are welded together to form the radiator section. The corrugated surfaces contain ridges and furrows for increasing the effective surface area of the panels. The ridges on one panel are aligned with the furrows on its mating panel, thereby providing a constant cross-sectional area for the duct. Each panel is constructed similar to each other, with mating panels usually being aligned to match the original bottom of one panel to the original top of the other panel. The flanges are formed into these panels and are dimensioned to allow the flanges to telescope together to form a header for the radiator. Adjacent radiator sections are positioned with the ridges on one panel aligned with the furrows on the facing panel.

BRIEF DESCRIPTION OF THE DRAWING

Further advantages and uses of this invention will become more apparent when considered in view of the following detailed description and drawing, in which:

FIG. 2 is a partial view of several radiator sections of a radiator assembly shown in FIG. 1;

FIG. 3 is a partial cross-sectional view of a radiator assembly constructed generally as shown in FIG. 2;

FIG. 6 is a partial view illustrating the alignment of adjacent radiator sections.

DESCRIPTION OF THE PREFERRED EMBODIMENTS

Figure 1:
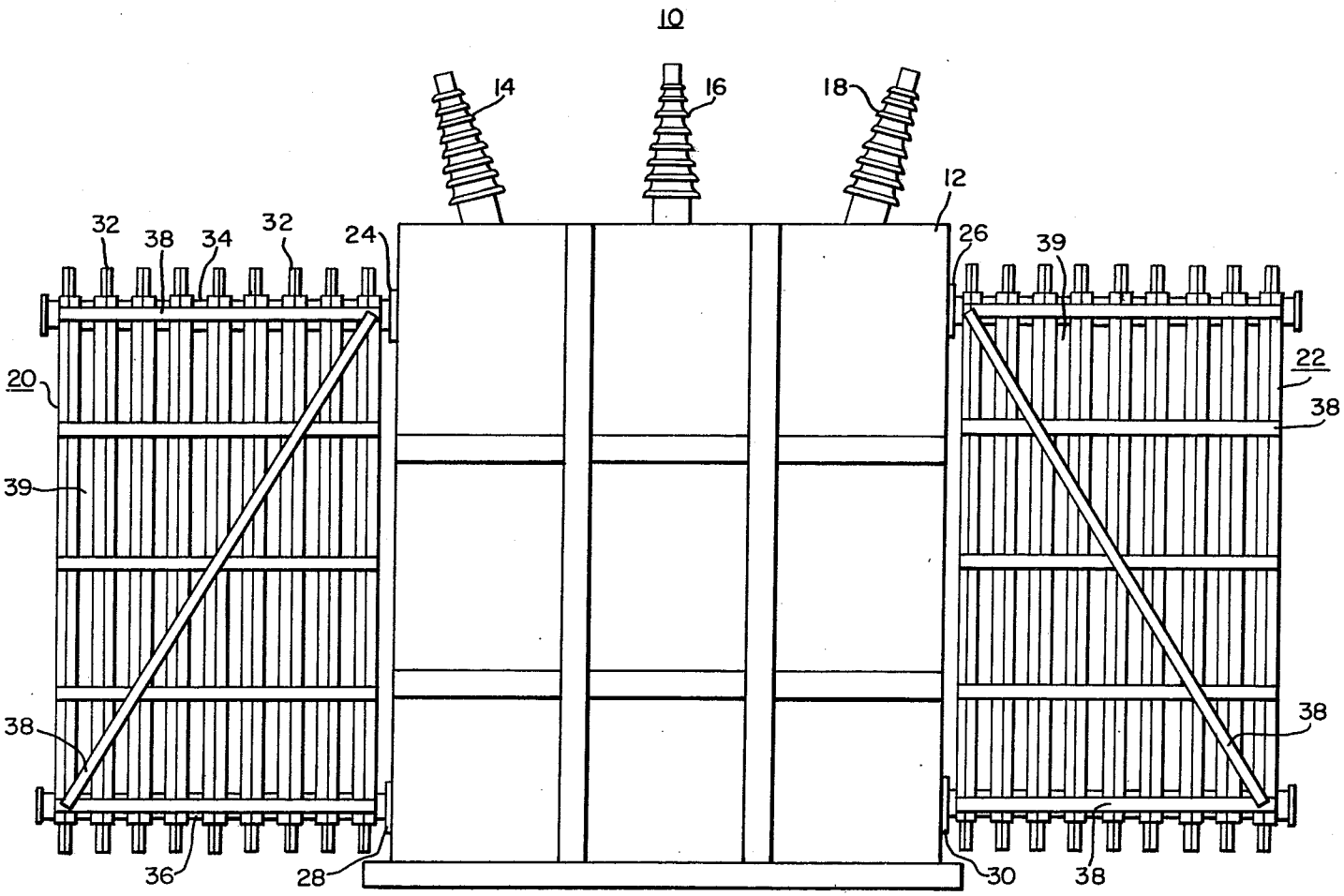
FIG. 1 is a side elevational view of a transformer having attached thereto radiator assemblies constructed according to this invention.

Throughout the following description, similar reference characters refer to similar elements or members in all of the Figures of the drawing.

Referring now to the drawing, and to FIG. 1 in particular, there is shown a power transformer 10 constructed according to this invention. The transformer tank 12 encloses the core and coil assembly of the transformer and contains a fluid dielectric, such as mineral oil, which helps to cool the core and coil assembly. The bushings 14, 16 and 18 are attached to the top of the transformer tank 12 and provide means for connecting the enclosed coils to an external electrical circuit.

The radiator assemblies 20 and 22 are connected on each side of the tank 12 and permit the flow of fluid coolant from the flanges on connections 24 and 26 to the flanges on connections 28 and 30, respectively. The construction illustrated is arranged for fluid circulation caused primarily by the differences in densities of fluids having different temperatures. In another arrangement using the apparatus of this invention, forced flow of the fluid coolant may be produced by inserting fluid pumps at appropriate positions in the flow path, such as near the connections 28 and 30.

Each radiator assembly includes a plurality of radiator sections, such as the radiator sections 32 of the radiator assembly 20. Each radiator section is connected to each other by a top flange and a bottom flange, such as the flanges 34 and 36, respectively. The reinforcing straps or braces 38 help to maintain the integrity of the radiator section assembly and support it from the transformer tank 12.

An air space 39 exists between each radiator section for the purpose of allowing the circulation of air between the sections to dissipate the heat transferred to the radiator sections from the hot fluid coolant. In some applications, the movement of the air between the radiator sections may be increased by placing fans adjacent to the radiator assemblies. In general, the ability of the radiator sections to transfer heat from the fluid coolant to the surrounding air is improved by increasing the rate of flow of the air across and between the radiator sections.

FIG. 2 is a partial view of the radiator assembly 20 shown in FIG. 1. Five radiator sections are illustrated in FIG. 2 and are identified by the reference numerals 40, 42, 44, 46 and 48. These radiator sections are identical to those sections indicated by the reference numeral 32 in FIG. 1. The mounting flange 24 includes bolt holes, such as the holes 50 and 52, which are used for connecting the radiator assembly to studs extending from the transformer tank 12. The flange 24 is welded to the flange 54 of the radiator section 40 and a suitable gasket would normally be placed between the flange 24 and the corresponding opening on the transformer tank.

The radiator sections are constructed identically to each other. The radiator section 40 includes the sheet metal panels 56 and 58 which have predetermined surface shapes and which are welded together to provide paths or ducts for the fluid coolant to flow between the panels. The corrugated surfaces 60 formed by alternate ridges and furrows across the panel 56, together with corrugated surface on the panel 58, form vertical ducts which direct the flow of fluid coolant through the radiator section 40. Hot oil enters through the opening 62 and flows in the space 64 between the panels 56 and 58 to the ducts formed by these panels, thereby transferring some of the heat of the coolant to the panel surfaces and ultimately to the surrounding air.

FIG. 3 is a partial cross-sectional view of the upper header portion of a radiator assembly constructed according to this invention. The flange 63 is connected to the flange extension 65 which is brazed or welded to the flange 66. The flange 66 is formed during the shaping of the panel 68 which comprises half of the radiator section 70. The other half of the radiator section 70 comprises the panel 72. The elements identified by the numbers 24, 54, 40, 56 and 58 in FIG. 2 correspond to the elements identified by the numbers 63, 65, 70, 68 and 72 in FIG. 3, respectively.

The dimensions of the flanges on the panels are such that adjacently positioned flanges can be telescoped together to aid the sealing and alignment of adjacent radiator sections. The panels 68 and 72 are identical, except that one is oriented upside down from the other. Therefore, the lower flange of the panel 68, which is not illustrated, has the same dimensions of the flange 74. Similarly, the lower flange of the panel 72, which is not illustrated, has the same dimensions as the flange 66. As will be discussed in more detail later, the corrugated surfaces of the panels 68 and 72 are also similar. Since each panel of the radiator assemblies 20 and 22 is constructed with the same shape, all of the panels may be manufactured from the same pressing machine, thus reducing tooling and inventory costs.

It is also within the scope of this invention that all of the panels may be manufactured identically and that both of the flanges on every other panel may be shaped similarly by an auxiliary operation. This alternate procedure would make the lower flange of the panel 68 the same as the flange 66, and the lower flange of the panel 72 the same as the flange 74. With this alternate construction process, it is not necessary to rotate adjacent panels lengthwise to orient them in an upside down configuration for the proper alignment of the panel corrugations. The panels may simply be rotated around their longitudinal axis to align the corrugations.

Spaces are provided between the panels of the same radiator section, such as the space 76 between the panels 78 and 80. Looking into the portion of the space 76 shown in FIG. 3, the mating surface 82 between the panels can be seen. This surface corresponds to the portions of the panels 78 and 80 which are shaped to contact each other when the panels are assembled. Usually, a seam weld is made along this surface. The corrugated surfaces 60, as shown in FIG. 2, include ridges and furrows which, when properly aligned, provide efficient heat transfer from the fluid coolant to the air. The furrows in the panels produce the indentations 84 and 86 which are visible when looking into the space 76 as shown in FIG. 3.

An end cap 88 is attached to the last radiator section as shown in FIG. 3 to terminate the header assembly formed by the panel flanges and openings. As with the telescoping flanges, the end cap 88 is welded or brazed to its mating surface. The end cap 88 includes a fill cap 90 which may be used to add or remove coolant from the radiator assembly.

Figure 4:
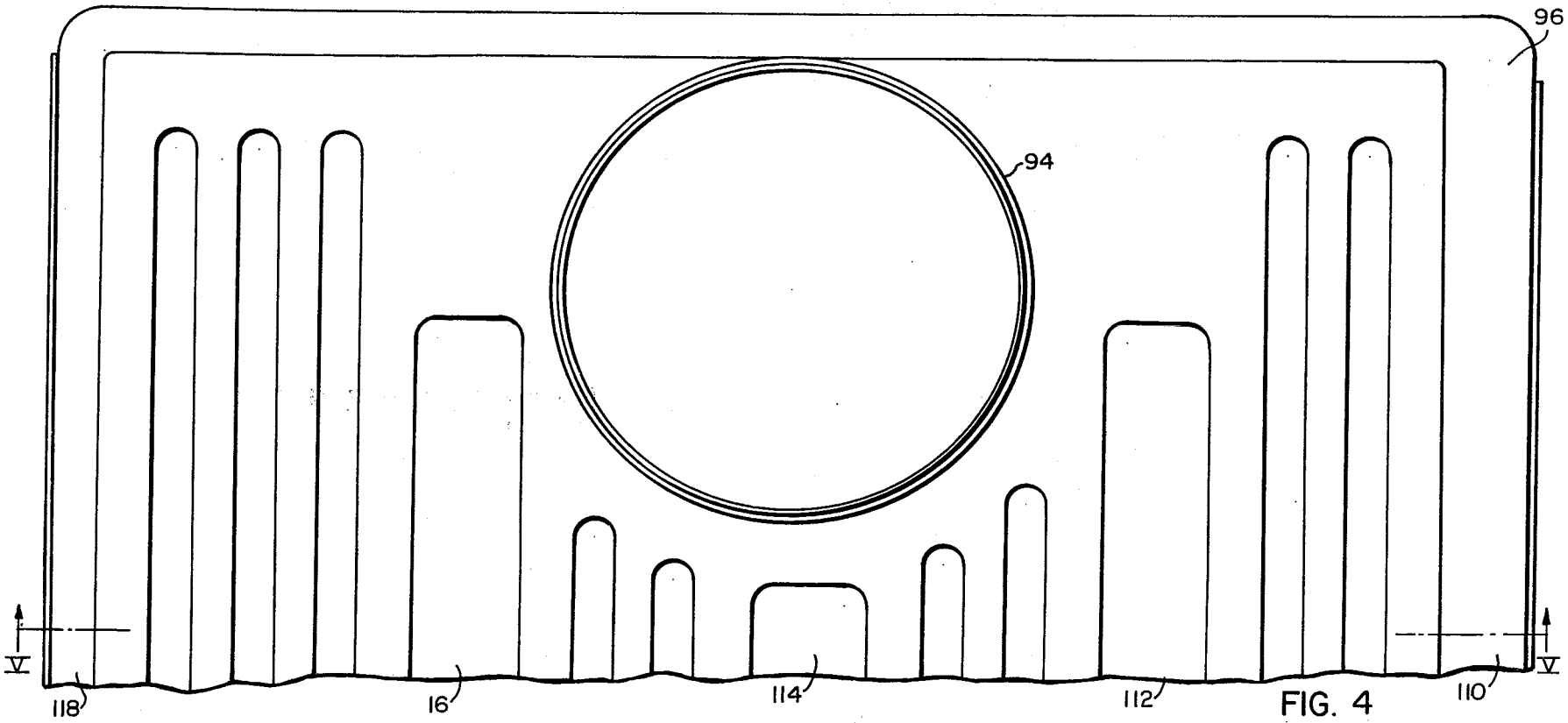
FIG. 4 is a partial elevational view of a radiator section constructed according to this invention.
Figure 5:
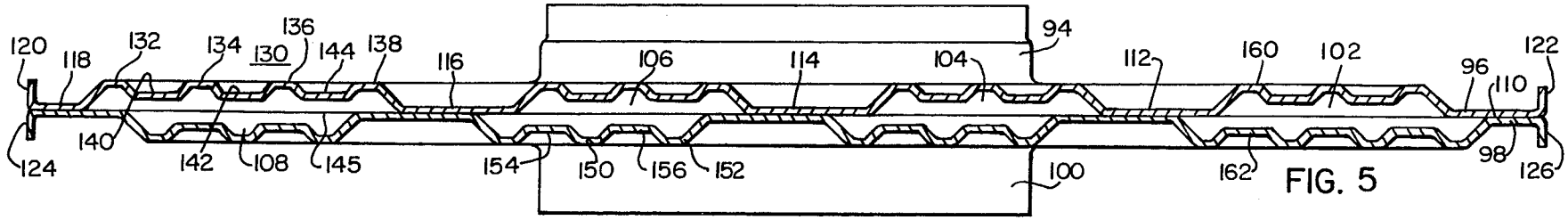
FIG. 5 is a cross-sectional view taken generally along the line V—V of FIG. 4.

FIG. 4 is a partial elevational view of a radiator section constructed according to this invention. FIG. 5 is a cross-sectional view of the radiator section shown in FIG. 4 taken along the line V—V. Referring to both FIGS. 4 and 5, it can be seen that the flange 94 projects from the panel 96 which is attached to the panel 98. The flange 94 and the flange 100 are used to connect the upper end of the radiator section to adjacent radiator sections to form a portion of the header system.

FIGS. 4 and 5 illustrate the arrangement and shape of the ducts 102, 104, 106 and 108 which extend through the radiator sections. The panels 96 and 98 are welded together at the positions 110, 112, 114, 116 and 118 by seam welds which extend substantially from the top flange area to the bottom flange area of the panels. The coolant flowing through the ducts transfers heat to the corrugated surfaces which define the ducts. This heat is transferred to the air flowing across the corrugated surfaces. The edges 120 and 122 of the panel 96 are bent at right angles to the general panel surface to provide additional heat transfer area and to provide a convenient surface to which the reinforcing braces may be attached. The edges 124 and 126 of the panel 98 are similarly shaped for the same reasons.

The corrugated surfaces which define the ducts have definite shapes and dimensions to provide an efficient heat transfer system. Each corrugated surface includes a series of ridges and furrows which are alternately positioned across the corrugated surface. For example, the corrugated surface 130 includes the ridges 132, 134, 136 and 138, and the furrows 140, 142 and 144. Ridges are characterized as extending away from the plane of intersection 145 between the panels 96 and 98. Furrows are characterized as extending toward the plane of intersection 145 between the panels 96 and 98. Thus, the panel 98 includes, among others, the ridges 150 and 152, and the furrows 154 and 156.

The total number of ridges and furrows on each panel of a radiator section are the same. This is ture since, as stated previously, at least the radiating portion of both panels are exactly the same, except that one is turned upside down before the panels are mated together, or turned around its longitudinal axis according to the alternate manufacturing process. A unique arrangement purposely occurs when the panels are constructed and aligned in this manner. The ridges on one panel are aligned with the furrows on its mating panel. For example, the ridge 160 is aligned with the furrow 162. This arrangement provides a relatively constant cross-sectional area for the coolant flow path through the duct 102. In other words, the flow of coolant is the same across substantially every portion of the corrugated panel area. If the furrows were aligned with each other, the furrows would conduct heat away from a smaller volume of coolant than would the ridges. Having the cross-sectional area relatively constant improve the efficiency of the radiator assembly.

FIG. 6 is a partial cross-sectional view of two adjacent radiator sections. The facing panels 166 and 168 are positioned with the furrows of the panel 168 aligned with the ridges of the panel 166. This provides a constant cross-sectional area for the flow path of the air which flows through the radiator assembly in the direction 170. It can be seen that, if the ridges were aligned with each other, the air flow path would be more restrictive. Thus, by providing a relatively unrestricted air flow path between the radiator sections, the heat transfer efficiency of the radiator assembly is improved.

The quantity of heat transferred from the corrugated surfaces is dependent upon the efficiency of the surface and the ratio of the exposed area to the raw steel area. Maximum heat transfer capability occurs when a pitch "P" to height "H" ratio between approximately four and ten exists. A smaller pitch to height ratio, that is one which is heavily contoured, does not allow the cooler air to contact the entire exposed area, thereby insulating it with a thick layer of stagnant air while increasing the resistance to the air flowing past the surface. A larger pitch to height ratio decreases resistance to air flow past the surface but reduces the heat transfer area. A preferred ratio of seven has been determined by experimentation. Also with a ratio of height "H" of the ridge above the furrow to spacing "S" between panels in the vicinity of 0.06, the heat transfer is improved. If this ratio is greater than 0.06, the resistance to air flow between the panels with fans attached thereto is increased.

With all of the efficiency improving arrangements of the radiator assembly described herein, it has been found that considerable improvements over prior art radiator assemblies can be made. It has been found that a 12-foot high and 150-inch long radiator assembly constructed according to the present invention had better characteristics than the same overall size radiator assembly constructed according to the prior art. Although the radiator section width was greater on the new radiator arrangement, the oil volume contained in the radiator assemblies was only slightly greater than the oil volume contained in the prior art radiator.

However, the effective surface area for the new radiator was approximately 40% greater than that of the prior art radiator.

Since numerous changes may be made in the above described apparatus, and since different embodiments of the invention may be made without departing from the spirit thereof, it is intended that all of the matter contained in the foregoing description, or shown in the accompanying drawing, shall be interpreted as illustrative rather than limiting.

I claim as my invention:

1. A radiator assembly for fluid filled electrical apparatus, comprising:

a plurality of radiator sections each constructed of at least first and second panels; said first and second panels each having a plurality of ridges and furrows forming a corrugated surface;

a header assembly connecting the radiator sections together in flow communication relationship; and means for connecting the header assembly to the fluid filled electrical apparatus;

said first and second panels being connected together such that said ridges and furrows form a plurality of ducts which extend through the panels, with the ridges of said first panel being aligned with the furrows of said second panel;

said radiator sections being aligned along a common axis such that the ridges on the first panel of one radiator section are aligned with the furrows on the facing panel of an adjacent radiator section, thereby providing a flow path between said radiator sections which has a substantially constant cross-sectional area.

2. The radiator assembly of claim 1 wherein the ratio between the pitch and height of the corrugated surfaces is between four and ten.

3. The radiator assembly of claim 1 wherein the ratio of the height of a ridge above a furrow to the spacing between adjacent radiator sections is about 0.06.

4. The radiator assembly of claim 1 wherein the first and second panels have vertical edges bent in angular relation to the general panel surface and away from the plane of intersection of both said panels, to provide additional heat transfer area.

5. A radiator assembly for fluid filled electrical apparatus, comprising:

at least first and second radiator sections each constructed of first and second panels; said first and second panels each having top and bottom ends; said first and second panels each containing a plurality of ridges and furrows thereon defining a corrugated surface, where the ratio of the pitch to the height of said ridges and furrows is between 4 and 10;

a header assembly connecting the radiator sections together in flow communication relationship; and means for connecting the header assembly to the fluid filled electrical apparatus;

said first and second panels being connected together such that said ridges and furrows form a plurality of ducts which extend substantially between said top and bottom ends of the panels, with the ridges of said first panel being aligned with the furrows of said second panel;

said first and second panels each having a first flange which surrounds a first opening at the top of the panel and a second flange which surrounds a second opening at the bottom of the panel, said first and second openings being located completely within the edges of the panel; and said first and second radiator sections being connected together by their flanges, with the ridges on the panel of the first radiator section which faces the second radiator section being aligned with the furrows on the panel of the second radiator section which faces the first radiator section;

said first and second radiator sections being spaced apart such that the ratio of the height of a ridge above a furrow to the spacing between said adjacent first and second radiator sections is about 0.06.

* * * * *